US012146241B2

(12) United States Patent
Zhang et al.

(10) Patent No.: US 12,146,241 B2
(45) Date of Patent: Nov. 19, 2024

(54) WHEAT GLUTEN NANOFIBER, METHOD FOR PREPARING THE SAME AND APPLICATION THEREOF

(71) Applicant: ZHEJIANG UNIVERSITY, Hangzhou (CN)

(72) Inventors: Hui Zhang, Hangzhou (CN); Yipeng Zhang, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 317 days.

(21) Appl. No.: 17/621,233

(22) PCT Filed: Mar. 11, 2021

(86) PCT No.: PCT/CN2021/080146
§ 371 (c)(1),
(2) Date: Dec. 20, 2021

(87) PCT Pub. No.: WO2021/223511
PCT Pub. Date: Nov. 11, 2021

(65) Prior Publication Data

US 2022/0349092 A1 Nov. 3, 2022

(30) Foreign Application Priority Data

May 6, 2020 (CN) ..... 202010376171.X

(51) Int. Cl.

| | |
|---|---|
| ***D01F 4/00*** | (2006.01) |
| ***D01D 1/02*** | (2006.01) |
| ***D01D 5/00*** | (2006.01) |
| ***D01F 1/10*** | (2006.01) |

(52) U.S. Cl.
CPC ..... *D01F 4/00* (2013.01); *D01D 1/02* (2013.01); *D01D 5/003* (2013.01); *D01F 1/103* (2013.01); *D10B 2505/10* (2013.01)

(58) Field of Classification Search
CPC .. D01F 4/00; D01F 1/103; D01D 1/02; D01D 5/003
See application file for complete search history.

(56) References Cited

FOREIGN PATENT DOCUMENTS

| | | | |
|---|---|---|---|
| CN | 101377023 | * | 3/2009 |
| CN | 106676669 | | 5/2017 |
| JP | 2004-169231 | * | 6/2004 |
| JP | 2010150712 | | 7/2010 |

* cited by examiner

*Primary Examiner* — Mathieu D Vargot
(74) *Attorney, Agent, or Firm* — Jiwen Chen; Joywin IP Law PLLC

(57) ABSTRACT

The invention discloses a method for preparing wheat gluten nanofibers, which comprises steps of: (1) dissolving wheat gluten and glycerol monolaurate in a solvent to obtain a spinning solution; the solvent is an aqueous acetic acid solution; a volume percentage concentration of the aqueous acetic acid solution is 40-60%; in the spinning solution, a mass percentage concentration of wheat gluten is 20-30%; (2) carrying out electrospinning with the spinning solution to obtain wheat gluten nanofibers. The wheat gluten nanofibers of the present invention have water stability and antibacterial function, and are obtained by electrospinning with wheat gluten as a raw material, so the wheat gluten nanofibers have good biocompatibility and biodegradability.

3 Claims, 5 Drawing Sheets

WHEAT GLUTEN NANOFIBER, METHOD FOR PREPARING THE SAME AND APPLICATION THEREOF

This is a U.S. national stage application of PCT Application No. PCT/CN2021/080146 under 35 U.S.C. 371, filed Mar. 11, 2021 in Chinese, claiming priority of Chinese Application No. 202010376171.X, filed May 6, 2020, all of which are hereby incorporated by reference.

FIELD OF TECHNOLOGY

The present invention relates to the technical field of polymer materials, in particular to wheat gluten nanofibers, a method for preparing the same and an application thereof.

BACKGROUND TECHNOLOGY

Electrospinning technology is a technology in which polymer solution overcomes the surface tension through high voltage electric field force to form Taylor cone at a syringe tip, before being sprayed at high speed as a charged jet, which solidifies after mechanical stretching and solvent volatilization to form nanofiber structures. Electrospun fiber materials have the advantages including large specific surface area, small pore size, high porosity, and can conveniently and efficiently carry substances with antioxidant and antibacterial activities, so they show superior properties and great application potential in the field of food packaging.

Wheat gluten is a by-product of wheat starch industry. It comprises as high as 75% proteins, mainly including gliadin, glutenin, albumin and globulin. Wheat gluten has many advantages, such as high nutritional value, low price, good biocompatibility and biodegradability. In addition, it has strong water absorption, viscoelasticity, film-forming ability and emulsifiability, and can significantly improve the strength of dough when mixed with water. Wheat gluten is often used in the fields of baked foods, meat-like products, pet foods, animal feeds. Since wheat gluten is rich in intermolecular and intramolecular disulfide bonds, the food-grade natural films prepared from wheat gluten have good flexibility and barrier property, and can be used in food packaging to replace chemical synthetic materials to prolong the shelf life of food.

Chinese patent with publication number CN101377023A discloses a method for producing nano-scale fibers by using wheat gluten, which comprises the following steps: (1) extraction of wheat gluten; (2) extraction of glutenin; (3) extraction of gliadin; (4) preparation of nanofibers by electrospinning glutenin mixed with a polymer; and (5) preparation of nanofibers by electrospinning gliadin mixed with a polymer. In the method, wheat gluten is subjected to extraction and separation, and then blended and electrospun together with the polymer to prepare nanofibers. However, the extraction and separation processes are complicated, and the selected polymer is polyvinyl alcohol, resulting in relatively poor biocompatibility and biodegradability.

Chinese patent with publication number CN106676669A discloses a method for preparing wheat gluten and polyvinyl alcohol composite nanofiber, which comprises the following steps: (1) extraction of wheat gluten; (2) preparation of spinning solution; (3) high-voltage electrospinning. According to this invention, wheat gluten and polyvinyl alcohol are used as raw materials, and a high-voltage electrospinning process is adopted to prepare wheat gluten/polyvinyl alcohol composite nanofibers with an average diameter of 280 nm, with smooth and uniform fiber morphology. However, because polyvinyl alcohol is a synthetic material, blend electrospinning will impair the biocompatibility and biodegradability, which limits the application of these nanofibers in food field.

SUMMARY OF THE INVENTION

The present invention provides wheat gluten nanofibers, a method for preparing the same and an application thereof. The wheat gluten nanofibers of the present invention have water stability and antibacterial function, and are obtained by electrospinning with wheat gluten as a raw material, so the wheat gluten nanofibers have good biocompatibility and biodegradability.

The specific technical solution is as follows:

A method for preparing wheat gluten nanofibers, comprises steps of:

(1) dissolving wheat gluten and glycerol monolaurate in a solvent to obtain a spinning solution;

(2) carrying out electrospinning with the spinning solution to obtain wheat gluten nanofibers.

Glycerol monolaurate is an excellent food emulsifier with an HLB (Hydrophilic-Lipophilic Balance) value of 5.2. It is also a safe, efficient and broad-spectrum antibacterial agent. It exists naturally in breast milk, coconut oil and palmetto, and can also be obtained by direct esterification of lauric acid and glycerol from natural oils and fats.

Glycerol monolaurate is a nonionic surfactant, which on one hand can reduce the surface tension and change the viscosity of the spinning solution, and improve the electrospinnability of wheat gluten. On the other hand, it can be dispersed on the surface of wheat gluten nanofibers by electrospinning, endowing wheat gluten nanofibers with good water stability and antibacterial function, which make the prepared wheat gluten nanofibers have broad application prospects in the field of food packaging.

Preferably, based on the mass of wheat gluten, glycerol monolaurate is added at an amount of 1-20%; more preferably 4-16%.

The concentration of wheat gluten in the spinning solution has a decisive influence on the electrospinnability of the spinning solution. When the concentration of wheat gluten is too high, the electrospinning process cannot be carried out smoothly due to too high viscosity of the spinning solution. When the concentration of wheat gluten is too low, the intermolecular entanglement in the spinning solution is not enough or there is no entanglement, which makes the jet fail to effectively resist the electric field force and thus break up.

Preferably, the mass percentage concentration of wheat gluten in the spinning solution is 20-30%; more preferably 20-25%.

The choice of solvent has great influence on the electrospinning performance of wheat gluten. Wheat gluten is a kind of complex protein with complex solubility. The selected solvent not only needs to be able to dissolve and disperse wheat gluten to a great extent, but also needs to have good volatility to ensure the implementation of electrospinning. In addition, the solvent should be non-toxic and can be used in food.

Preferably, the solvent is an aqueous acetic acid solution; further preferably, the volume percentage concentration of the aqueous acetic acid solution is 40-60%.

In the process of electrospinning, the spinning parameters to be controlled mainly include: voltage, collecting distance between collector and syringe tip, flow rate, etc. The spinning parameters will affect the morphological characteristics of the prepared nanofibers to a certain extent.

Preferably, in the step (2), the electrospinning is carried out with a voltage of 15-25 kV, a collecting distance of 10-15 cm, and a flow rate of 0.25-0.5 ml/h.

The present invention further provides wheat gluten nanofibers prepared by the above method; and the present invention further provides an application of the wheat gluten nanofibers in food packaging.

Compared with the prior part, the present invention has the following beneficial effects:

(1) The electrospinnability of wheat gluten is improved by adding monoglyceride laurate, and wheat gluten nanofibers with a uniform morphology are prepared;

(2) The hydrogen bonding between monoglyceride laurate and wheat gluten endows the nanofibers with good water stability and antibacterial function.

(3) Wheat gluten, glycerol monolaurate and acetic acid solvent are of food grade, have good biocompatibility and safety, and are all biodegradable materials;

(4) The process for preparing the wheat gluten nanofiber of the present invention is simple, the conditions are mild, and the cost is low, so it is suitable for industrial production.

DESCRIPTION OF THE EMBODIMENTS

Example 1

2.5 g of wheat gluten and 0.1 g of glycerol monolaurate were dissolved in 10 mL of a 50% aqueous acetic acid solution, and magnetically stirred until they were completely dissolved to obtain a homogeneous spinning solution.

The spinning solution obtained above was electrospun by using an electrospinning device with a 2.5 mL syringe having a 20 G steel needle under the conditions of a voltage of 15 kV, a flow rate of 0.5 mL/h, a collecting distance of 10 cm, and a rotating drum was used for collecting, thereby obtaining wheat gluten nanofibers marked as G4. The SEM image of G4 is shown in FIG. 1.

Figure 2:
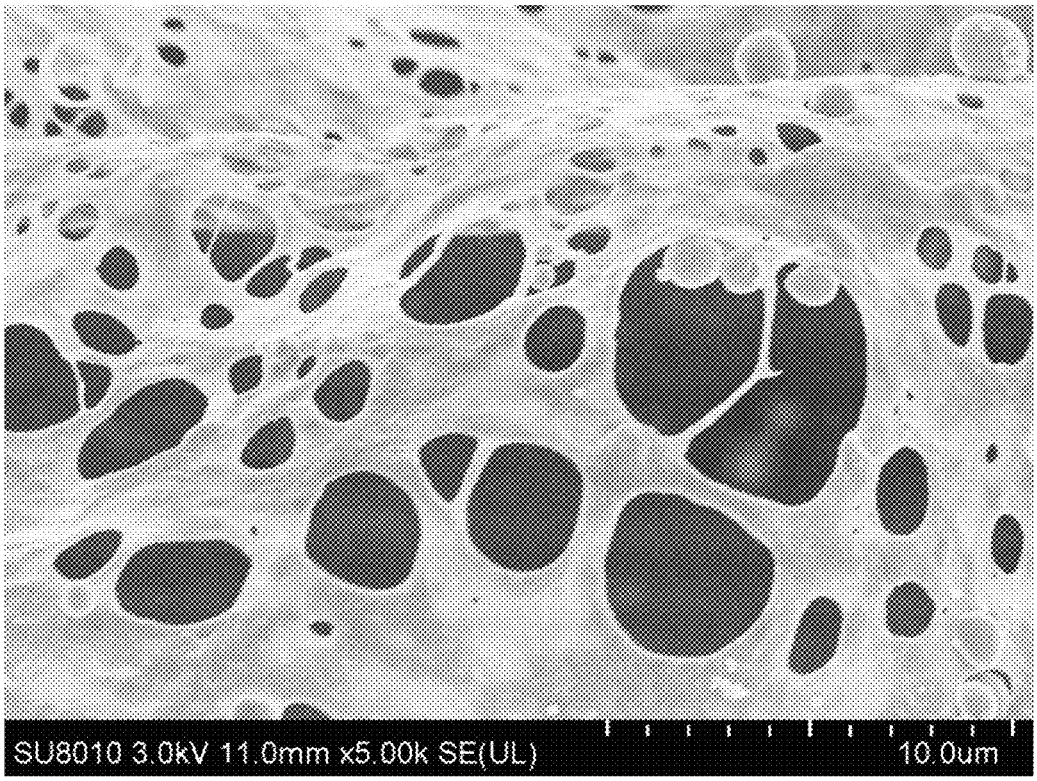
FIG. 2 is an SEM image of wheat gluten nanofibers prepared in Example 1 after immersed in water for 7 days and then freeze-dried.

The obtained wheat gluten nanofibers were immersed in water at room temperature for 7 days, then taken out, freeze-dried and observed by SEM, as shown in FIG. 2. The obtained wheat gluten nanofiber was cut into 12 mm-diameter disks, which were pasted on plates coated with *Staphylococcus aureus* and *Escherichia coli* (concentration of bacterial solution, $10^{-8}$ CFU) respectively, and cultured at 37° C. for 24 hours. The antibacterial activity was evaluated by the size of the inhibition zone.

Figure 1:
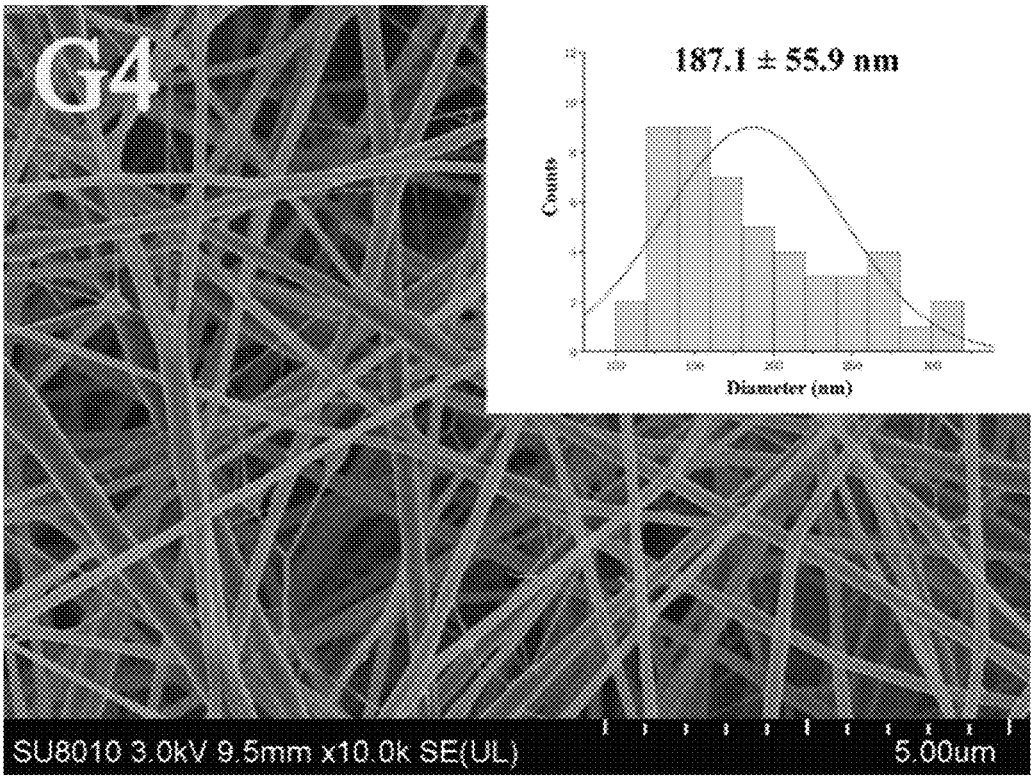
FIG. 1 is an SEM (scanning electron microscope) image of wheat gluten nanofibers prepared in Example 1.

As shown in FIG. 1, the wheat gluten nanofibers obtained in Example 1 have an average diameter of 187.1 nm, with uniform morphology and free of beaded structures. After immersed in water for 7 days, the nanofibers swelled, but still maintained the fiber network morphology, as shown in FIG. 2.

Example 2

2.5 g of wheat gluten and 0.2 g of glycerol monolaurate were dissolved in 10 mL of a 50% aqueous acetic acid solution, and magnetically stirred until they were completely dissolved to obtain a homogeneous spinning solution.

The spinning solution obtained above was electrospun by using an electrospinning device with a 2.5 mL syringe having a 20 G steel needle under the conditions of a voltage of 15 kV, a flow rate of 0.5 mL/h, a collecting distance of 10 cm, and a rotating drum was used for collecting, thereby obtaining wheat gluten nanofibers marked as G8. The SEM image of G8 is shown in FIG. 3.

The obtained wheat gluten nanofibers were tested for their water stability (SEM image shown in FIG. 4) and antibacterial activity, with the steps being the same as those in Example 1.

Figure 3:
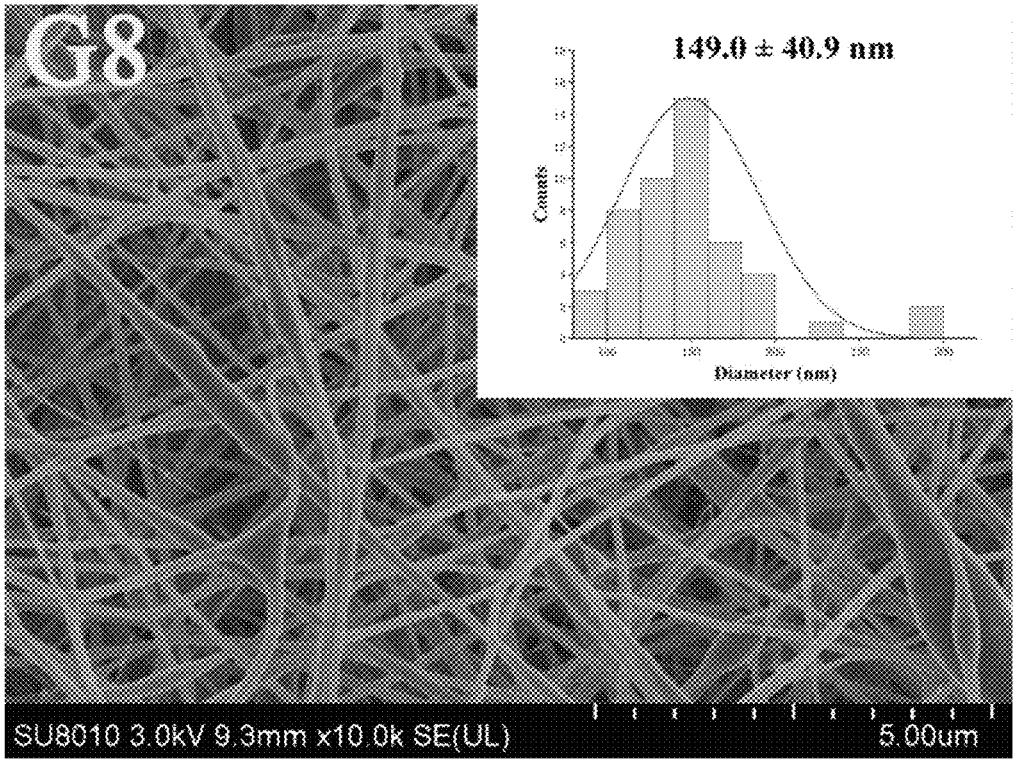
FIG. 3 is an SEM image of wheat gluten nanofibers prepared in Example 2.
Figure 4:
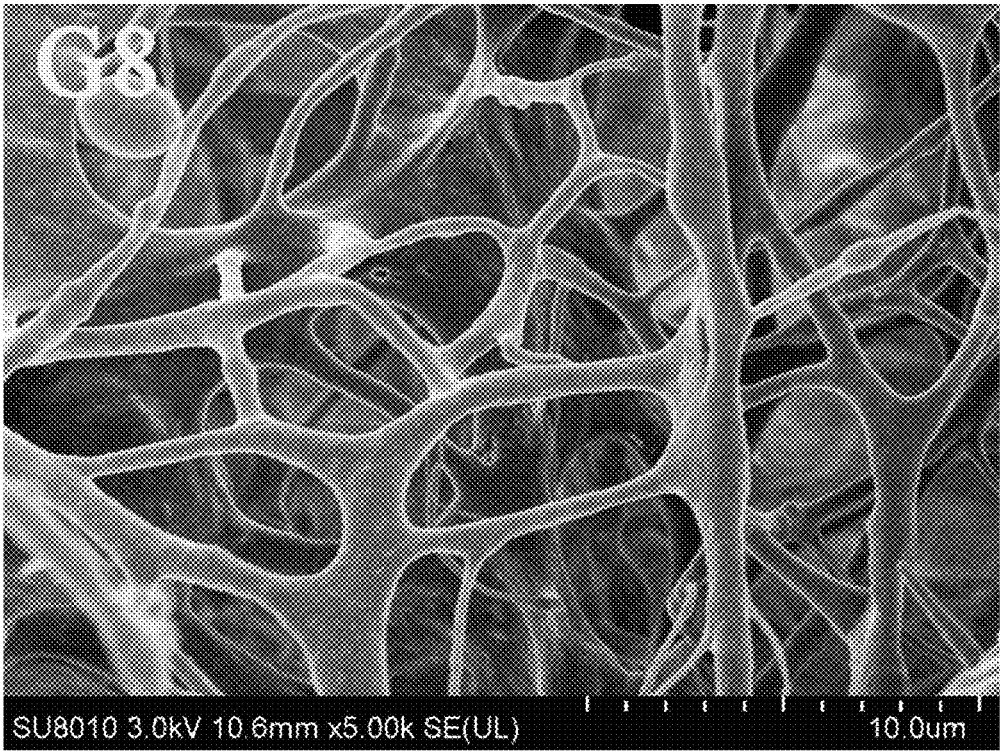
FIG. 4 is an SEM image of wheat gluten nanofibers prepared in Example 2 after immersed in water for 7 days and then freeze-dried.

As shown in FIG. 3, the wheat gluten nanofibers obtained in Example 2 have an average diameter of 149.0 nm, with uniform morphology and free of beaded structures. After immersed in water for 7 days, the nanofibers swelled, but still maintained the fiber network morphology, as shown in FIG. 4.

Example 3

2.5 g of wheat gluten and 0.3 g of glycerol monolaurate were dissolved in 10 mL of a 50% aqueous acetic acid solution, and magnetically stirred until they were completely dissolved to obtain a homogeneous spinning solution.

The spinning solution obtained above was electrospun by using an electrospinning device with a 2.5 mL syringe having a 20 G steel needle under the conditions of a voltage of 15 kV, a flow rate of 0.5 mL/h, a collecting distance of 10 cm, and a rotating drum was used for collecting, thereby obtaining wheat gluten nanofibers marked as G12. The SEM image of G12 is shown in FIG. 5.

The obtained wheat gluten nanofibers were tested for their water stability (SEM image shown in FIG. 6) and antibacterial activity, with the steps being the same as those in Example 1.

Figure 5:
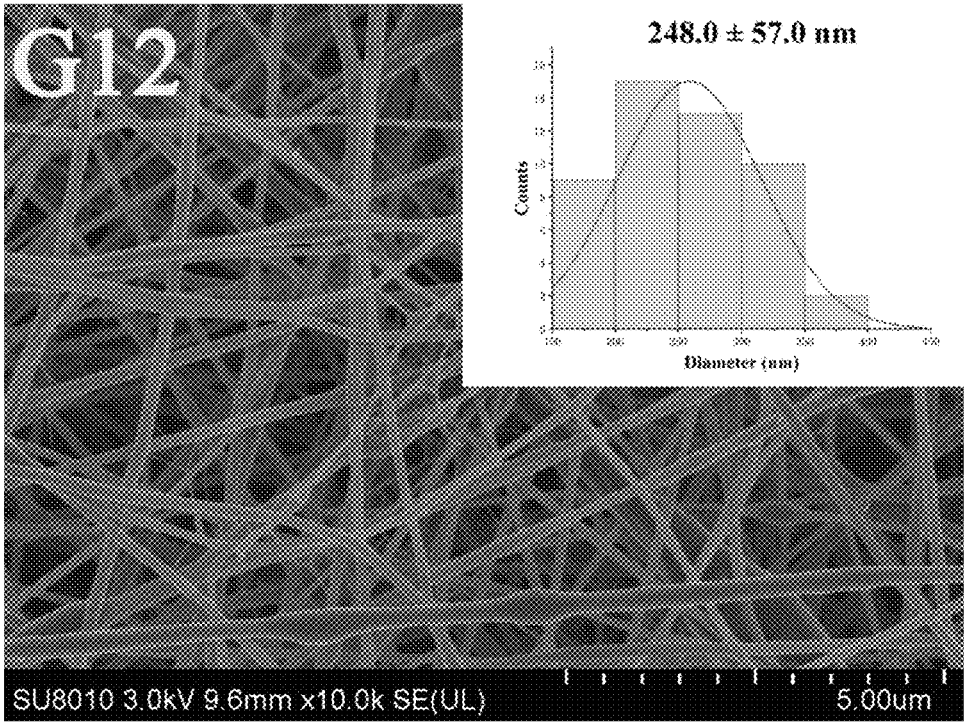
FIG. 5 is an SEM image of wheat gluten nanofibers prepared in Example 3.
Figure 6:
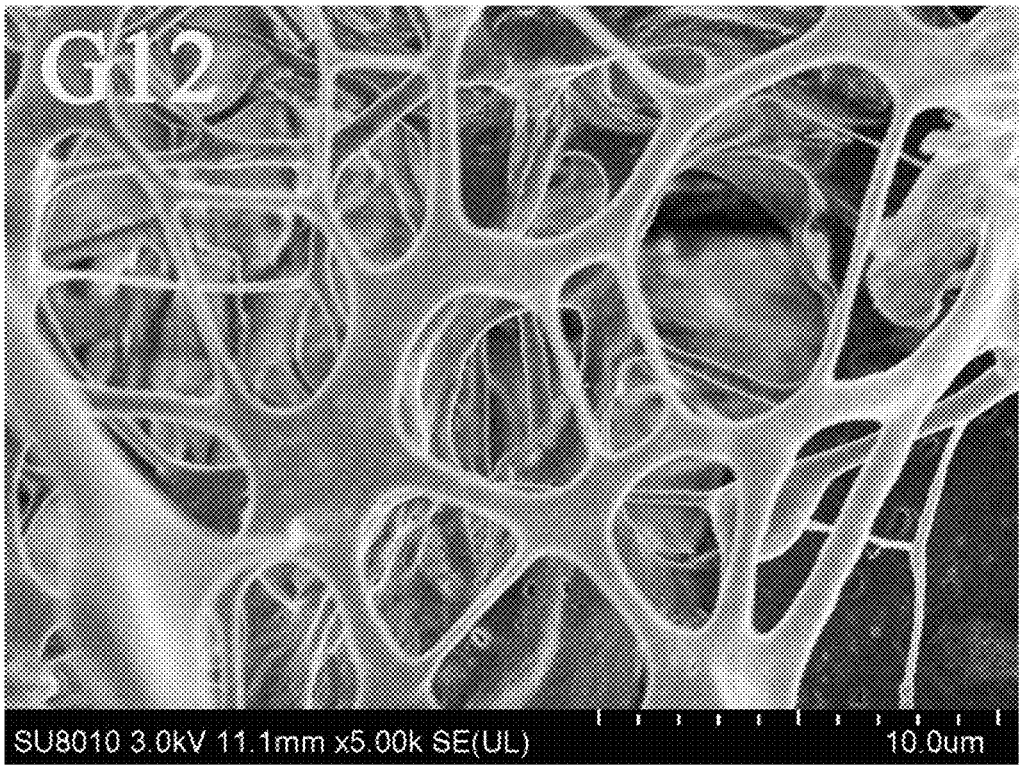
FIG. 6 is an SEM image of wheat gluten nanofibers prepared in Example 3 after immersed in water for 7 days and then freeze-dried.

As shown in FIG. 5, the wheat gluten nanofibers obtained in Example 3 have an average diameter of 248.0 nm, with uniform morphology and free of beaded structures. After immersed in water for 7 days, the nanofibers swelled, but still maintained the fiber network morphology, as shown in FIG. 6.

Example 4

2.5 g of wheat gluten and 0.4 g of glycerol monolaurate were dissolved in 10 mL of a 50% aqueous acetic acid solution, and magnetically stirred until they were completely dissolved to obtain a homogeneous spinning solution.

The spinning solution obtained above was electrospun by using an electrospinning device with a 2.5 mL syringe having a 20 G steel needle under the conditions of a voltage of 15 kV, a flow rate of 0.5 mL/h, a collecting distance of 10 cm, and a rotating drum was used for collecting, thereby obtaining wheat gluten nanofibers marked as G16. The SEM image of G16 is shown in FIG. 7.

The obtained wheat gluten nanofibers were tested for their water stability (SEM image shown in FIG. 8) and antibacterial activity, with the steps being the same as those in Example 1.

Figure 7:
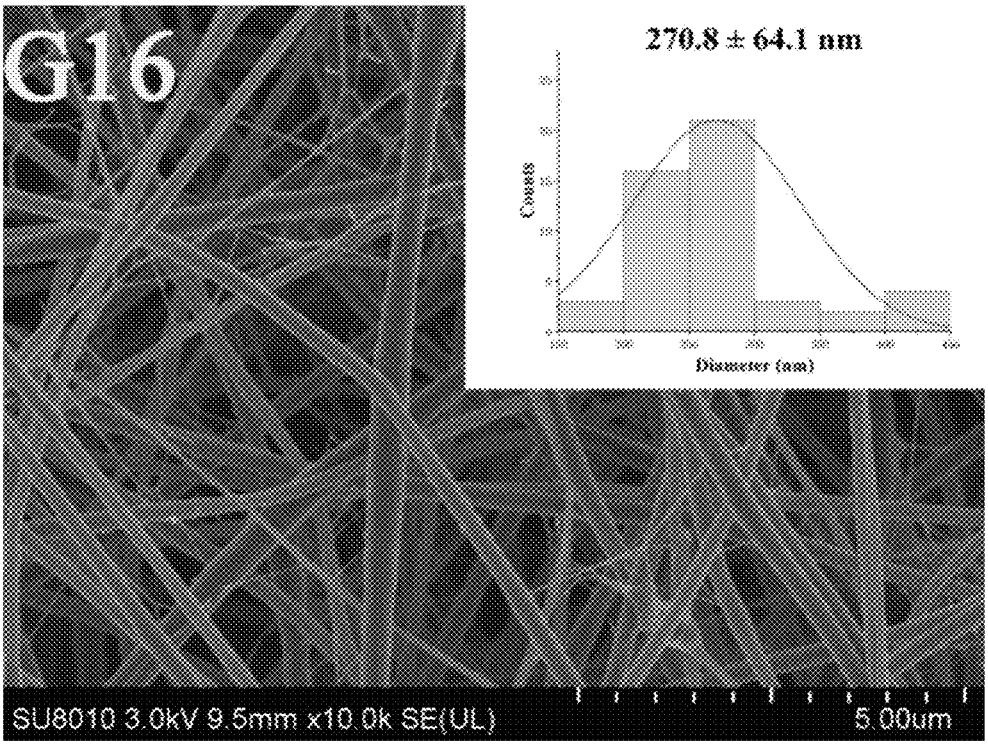
FIG. 7 is an SEM image of wheat gluten nanofibers prepared in Example 4.
Figure 8:
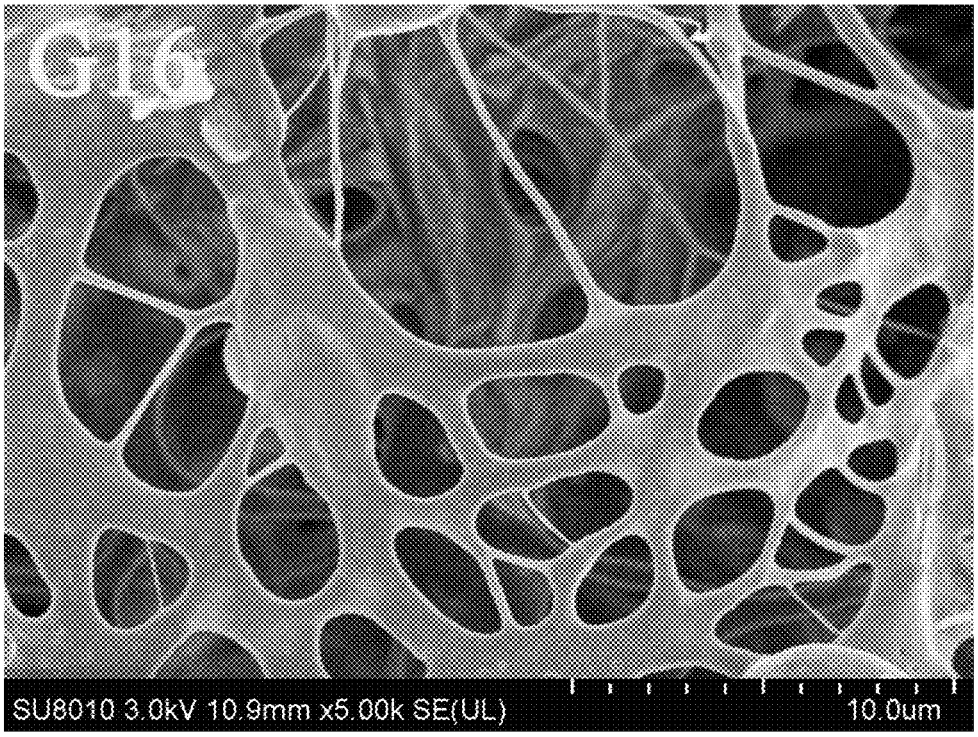
FIG. 8 is an SEM image of wheat gluten nanofibers prepared in Example 4 after immersed in water for 7 days and then freeze-dried.

As shown in FIG. 7, the wheat gluten nanofibers obtained in Example 4 have an average diameter of 270.8 nm, with uniform morphology and free of beaded structures. After immersed in water for 7 days, the nanofibers swelled, but still maintained the fiber network morphology, as shown in FIG. 8.

Comparative Example 1

2.5 g of wheat gluten was dissolved in 10 mL of a 50% aqueous acetic acid solution, and magnetically stirred until they were completely dissolved to obtain a homogeneous spinning solution.

The spinning solution obtained above was electrospun by using an electrospinning device with a 2.5 mL syringe having a 20 G steel needle under the conditions of a voltage of 15 kV, a flow rate of 0.5 mL/h, a collecting distance of 10 cm, and a rotating drum was used for collecting, thereby obtaining wheat gluten nanofibers without glycerol monolaurate marked as G0. The SEM image of G0 is shown in FIG. 9.

The obtained wheat gluten nanofibers were tested for water stability (SEM image shown in FIG. 10) and antibacterial activity, with the steps being the same as those in Example 1.

Figure 9:
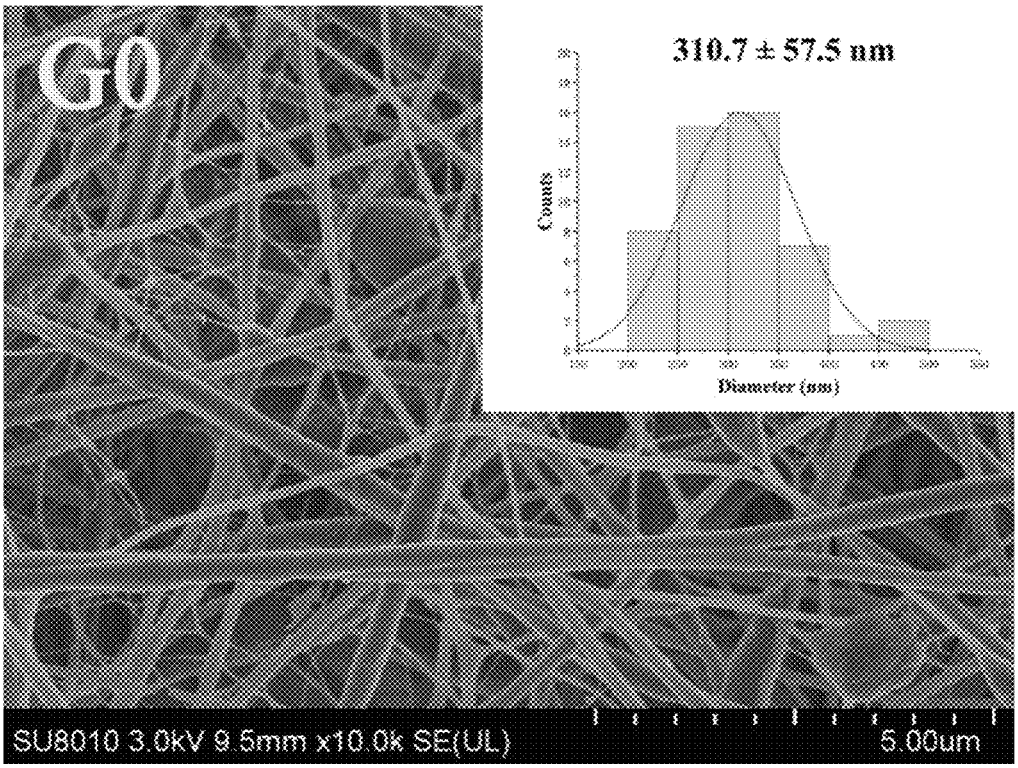
FIG. 9 is an SEM image of wheat gluten nanofibers prepared in Comparative Example 1.
Figure 10:
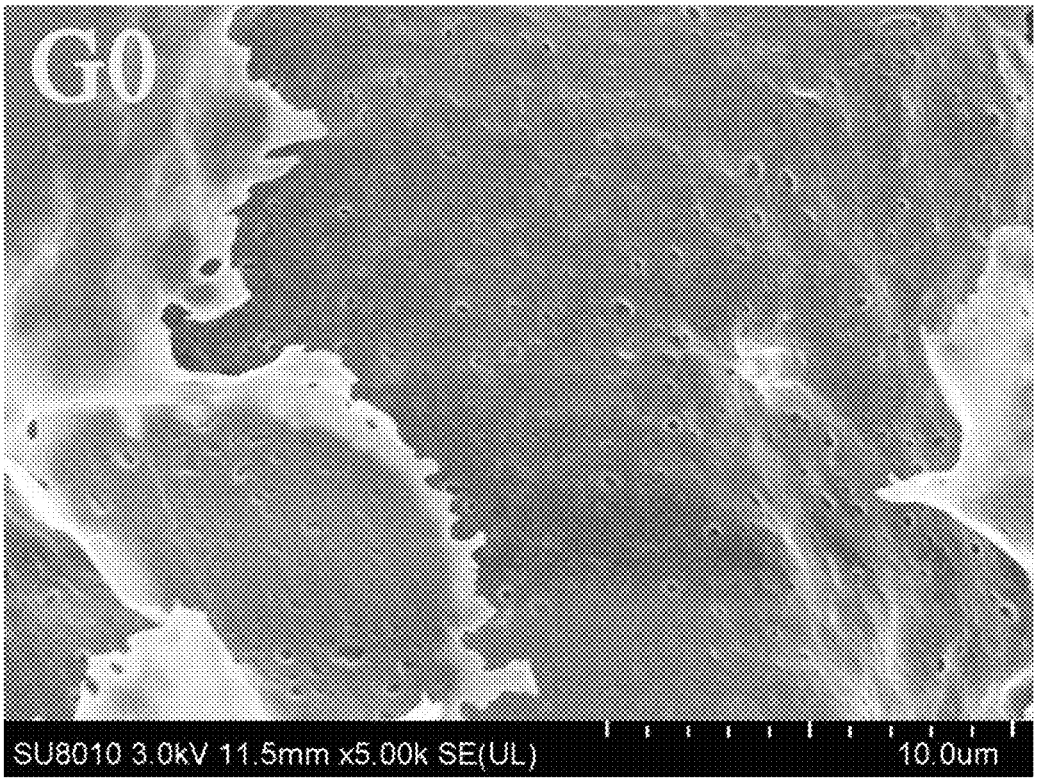
FIG. 10 is an SEM image of wheat gluten nanofibers prepared in Comparative Example 1 after immersed in water for 7 days and then freeze-dried.

As shown in FIG. 9, the wheat gluten nanofibers obtained in Comparative Example 1 have an average diameter of 310.7 nm, with uneven morphology and beaded structures. After immersed in water for 7 days, the morphology of the nanofibers completely disintegrated and disappeared, as shown in FIG. 10.

Evaluation of antibacterial efficacies of the wheat gluten nanofibers prepared in Examples 1, 2, 3 and 4 and Comparative Example 1 against *Staphylococcus aureus* and *Escherichia coli* is shown in Table 1.

TABLE 1

| Sample | Bacteria inhibition zone diameter (mm) | |
|---|---|---|
| | *Escherichia coli* | *Staphylococcus aureus* |
| G0 | 0 | 0 |
| G4 | 13.0 ± 0.65[c] | 17.5 ± 0.91[d] |
| G8 | 15.5 ± 0.93[b] | 19.5 ± 1.51[c] |

TABLE 1-continued

| Sample | Bacteria inhibition zone diameter (mm) | |
|---|---|---|
| | *Escherichia coli* | *Staphylococcus aureus* |
| G12 | 15.7 ± 0.81[b] | 22.0 ± 2.42[b] |
| G16 | 18.5 ± 1.51[a] | 25.0 ± 2.12[a] |

Note:
The superscript letters (a, b, c and d) represent significant difference with $p < 0.05$.

As shown in Table 1, the wheat gluten nanofibers obtained in Comparative Example 1 have no antibacterial efficacy, but the wheat gluten nanofibers obtained in Examples 1, 2, 3 and 4 have inhibitory effects against *Escherichia coli* and *Staphylococcus aureus*. Moreover, with the increasing glycerol monolaurate content, the inhibition zone diameter of the nanofibers gradually increases, that is, the antibacterial efficacy increases significantly.

The above-mentioned embodiments have explained the technical solution and beneficial effects of the present invention in detail. It should be understood that the above-mentioned embodiments are only specific embodiments of the present invention, and are not used to limit the present invention. Any modifications, supplements and equivalent substitutions made within the principle of the present invention should be included in the protection scope of the present invention.

What is claimed is:

1. A method for preparing wheat gluten nanofibers with improved water stability and antibacterial property, consisting of steps of:

(1) dissolving wheat gluten and glycerol monolaurate in a solvent to obtain a spinning solution; wherein the solvent is an aqueous acetic acid solution; a volume percentage concentration of the aqueous acetic acid solution is 40-60%;

the glycerol monolaurate is added at an amount of 1-20% based on the mass of wheat gluten;

in the spinning solution, a mass percentage concentration of wheat gluten is 20-30%; and;

(2) carrying out electrospinning with the spinning solution to obtain wheat gluten nanofibers with network fiber shape;

wherein the electrospinning is carried out with a voltage of 15-25 kV, a collecting distance of 10-15 cm, and a flow rate of 0.25-0.5 ml/h;

wherein the improved water stability means that, after the wheat gluten nanofibers being soaked in water for 7 days, the wheat gluten nanofibers still maintain the network fiber shape; and wherein the antibacterial property means that the wheat gluten nanofibers have inhibitory effects on *Escherichia coli* and *Staphylococcus aureus*.

2. Wheat gluten nanofibers with improved water stability and antibacterial property, wherein the wheat gluten nanofibers are prepared according to the method of claim 1.

3. A method of making food packaging material comprising the step of utilizing the wheat gluten nanofibers according to claim 2.

* * * * *